US011859449B2

(12) United States Patent
Li et al.

(10) Patent No.: US 11,859,449 B2
(45) Date of Patent: Jan. 2, 2024

(54) SYSTEMS FOR A DISSOLVABLE MATERIAL BASED DOWNHOLE TOOL

(71) Applicant: SAUDI ARABIAN OIL COMPANY, Dhahran (SA)

(72) Inventors: Bodong Li, Dhahran (SA); Jianhui Xu, Dhahran (SA); Abrar Alshaikh, Saihat (SA); Chinthaka P. Gooneratne, Dhahran (SA); Guodong Zhan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/643,657

(22) Filed: Dec. 10, 2021

(65) Prior Publication Data

US 2023/0184103 A1 Jun. 15, 2023

(51) Int. Cl.
*E21B 47/12* (2012.01)
*E21B 34/06* (2006.01)

(52) U.S. Cl.
CPC ..... *E21B 47/138* (2020.05); *E21B 34/063* (2013.01); *E21B 2200/08* (2020.05)

(58) Field of Classification Search
CPC ... E21B 47/138; E21B 34/063; E21B 2200/08
See application file for complete search history.

(56) References Cited

U.S. PATENT DOCUMENTS 7,766,084 B2 8/2010 Churchill
10,472,908 B2 11/2019 Radford et al.
11,174,693 B2 * 11/2021 Fripp ..... E21B 34/06
2002/0185273 A1 * 12/2002 Aronstam ..... E21B 47/138 166/250.01
2004/0084186 A1 * 5/2004 Allison ..... E21B 41/02 166/305.1
2004/0222018 A1 11/2004 Sullivan et al.
(Continued)

OTHER PUBLICATIONS

Takahashi, Shinya et al., "Development and Verification of Degradable Sealing Elements for Fully Degradable Frac Plugs"; Proceedings of the SPE Asia Pacific Unconventional Resources Conference and Exhibition; Paper No. SPE-176917-MS; pp. 1-10; Nov. 9, 2015 (10 pages).

(Continued)

*Primary Examiner* — Theodore N Yao
(74) *Attorney, Agent, or Firm* — Osha Bergman Watanabe & Burton LLP

(57) ABSTRACT

A downhole sub has a body defined by a wall extending in an axial direction from a first end to a second end. An inner surface of the wall defines a flow path through the downhole sub and an outer surface of the wall defines an outer diameter of the downhole sub. A compartment extends from the outer surface into the wall to having a depth less than a thickness of the wall. A housing may be removably fixed in the compartment. One or more mobile devices may be disposed in the housing. Each of the one or more mobile devices includes a sensor encapsulated in a protective material. A control element may block an opening of the housing, the control element is made of a dissolvable material configured to dissolve at a predetermined depth in a wellbore and release the one or more mobile devices into the wellbore.

14 Claims, 11 Drawing Sheets

(56) References Cited

U.S. PATENT DOCUMENTS

| | | | | |
|---|---|---|---|---|
| 2006/0086503 | A1* | 4/2006 | Reddy | C04B 40/0658 166/293 |
| 2011/0191028 | A1* | 8/2011 | Ross | E21B 47/26 702/6 |
| 2011/0277544 | A1* | 11/2011 | Rytlewski | E21B 47/11 73/152.18 |
| 2012/0097385 | A1* | 4/2012 | Villareal | E21B 49/081 166/162 |
| 2013/0118733 | A1* | 5/2013 | Kumar | E21B 47/26 166/254.2 |
| 2014/0299756 | A1* | 10/2014 | Cameron | E21B 27/02 250/259 |
| 2016/0040524 | A1* | 2/2016 | Ravi | E21B 33/13 166/253.1 |
| 2017/0009563 | A1 | 1/2017 | Holder | |
| 2017/0067312 | A1 | 3/2017 | Frazier et al. | |
| 2018/0171738 | A1 | 6/2018 | Xu et al. | |
| 2018/0245448 | A1 | 8/2018 | Fripp et al. | |
| 2019/0234179 | A1 | 8/2019 | Walton et al. | |
| 2019/0323311 | A1* | 10/2019 | Al-Qasim | E21B 27/00 |
| 2019/0352989 | A1 | 11/2019 | Tubel | |
| 2020/0141211 | A1 | 5/2020 | Franklin et al. | |
| 2020/0370390 | A1 | 11/2020 | Jabari et al. | |
| 2020/0378242 | A1 | 12/2020 | Jabari et al. | |
| 2020/0408080 | A1* | 12/2020 | Simeonov | E21B 41/00 |
| 2021/0040832 | A1 | 2/2021 | Montalvo et al. | |
| 2021/0079744 | A1 | 3/2021 | Tubridy | |
| 2021/0123341 | A1 | 4/2021 | Jabari et al. | |
| 2021/0172281 | A1* | 6/2021 | Li | E21B 21/003 |
| 2022/0112786 | A1* | 4/2022 | Thomason | E21B 27/00 |

OTHER PUBLICATIONS

Fripp, Michael et al., "Degradable Metal for Use in a Fully Dissolvable Frac Plug"; Proceedings of the Offshore Technology Conference; Paper No. OTC-27187-MS; pp. 1-9; May 2, 2016 (9 pages).

Kumar, Deepak et al., "Temporary Coating for Dissolving Frac-Balls Used in Multi-Stage Fracturing Systems"; Proceedings of the Offshore Technology Conference; Paper No. OTC-28862-MS; pp. 1-5; Apr. 30, 2018 (5 pages).

* cited by examiner

SYSTEMS FOR A DISSOLVABLE MATERIAL BASED DOWNHOLE TOOL

BACKGROUND

Fluids are typically produced from a reservoir in a formation by drilling a wellbore into the formation, establishing a flow path between the reservoir and the wellbore, and conveying the fluids from the reservoir to the surface through the wellbore. To drill the wellbore, a drill bit attached to a drill string is used to drill through the formation. During drilling operations, the drill bit and drill string encounter harsh downhole drilling conditions such as high temperature and pressure as well as interfacing with the hard rock of the formations being drilled. Conventional methods use estimations of temperature and pressure to engineer the plan of well drilling operations. These values are obtained through indirect calculations using values from offset wells and hold many sources of inaccuracy and error. Additional data that is needed during drilling operation is the wellbore directional survey, which provides information of the shape of the borehole subsurface, whether during or after drilling the respective wellbore section. Conventionally, shallow and vertical wellbore sections are surveyed after drilling using a mechanical drift recorder, which only determines a rough value for an inclination of the wellbore. Deeper wellbore sections use wireline surveys and gyro surveys to provide more accurate measurements, but also come with the cost of time and money deficiency mainly due to the need of multiple trips and the use of wireline. Directional and more critical wellbore sections are usually surveyed during drilling, using costly MWD (measurement while drilling) or GWD (gas while drilling) tools, providing real-time accurate measurements.

In some embodiments, downhole mobile devices may be used to take downhole measurements. Downhole mobile devices are typically electronic devices of different shapes (for example, spherical, pill, bullet, etc.) and sizes (from submillimeter to tens and up to a few hundred millimeters in diameter). Conventionally, the downhole mobile device are compact, lightweight, and stand-alone systems, with millimeter-range footprint that are composed of sensors and other electronics components encapsulated in protective material, used for downhole measurements as well as data transfer. For example, the downhole mobile device collect downhole data such as: wellbore directional survey, downhole in-situ data, temperature profile, pressure profile, 3D survey data.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole sub having a body defined by a wall extending in an axial direction from a first end to a second end. An inner surface of the wall defines a flow path through the downhole sub and an outer surface of the wall defines an outer diameter of the downhole sub. Additionally, the downhole sub includes a compartment extending from the outer surface into the wall to having a depth less than a thickness of the wall. A housing may be removably fixed in the compartment. One or more mobile devices may be disposed in the housing. Each of the one or more mobile devices includes a sensor encapsulated in a protective material. Further, a control element may block an opening of the housing, the control element is made of a dissolvable material configured to dissolve at a predetermined depth in a wellbore and release the one or more mobile devices into the wellbore.

In another aspect, embodiments disclosed herein relate to a system that may include a drill string comprising one or more drill pipes connected to form a conduit within a wellbore; and a bottom hole assembly disposed at the distal end of the conduit. The bottom hole assembly may include a drill bit and one or more downhole subs axially above the drill bit. The one or more downhole subs may include a body defined by a wall extending in an axial direction from a first end to a second end, an inner surface of the wall defines a flow path through the downhole sub and an outer surface of the wall defines an outer diameter of the downhole sub; a compartment extending from the outer surface into the wall to having a depth less than a thickness of the wall; a housing removably fixed in the compartment; one or more mobile devices disposed in the housing, each of the one or more mobile devices comprises a sensor encapsulated in a protective material; and a control element blocking an opening of the housing, the control element is made of a dissolvable material configured to dissolve at a predetermined depth in a wellbore and release the one or more mobile devices into an annulus between the wellbore and the drill string.

In yet another aspect, embodiments disclosed herein relate to a method that may include disposing one or more mobile devices in a storage compartment of a housing; closing the storage compartment by inserting a control element in an opening of the housing to store the one or more mobile devices in the storage compartment; removably fixing the housing in a compartment of a downhole sub; coupling the downhole sub to a bottom hole assembly disposed at a distal end of a drill string; lowering the downhole sub into a wellbore to reach a predetermined depth; deploying the one or more mobile devices into an annulus between the wellbore and the drill string by dissolving the control element at the predetermined depth to release the one or more mobile device; collecting downhole measurements at the predetermined depth with the one or more mobile devices; and transmitting the collected downhole measurements to a surface.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

Figure 1:
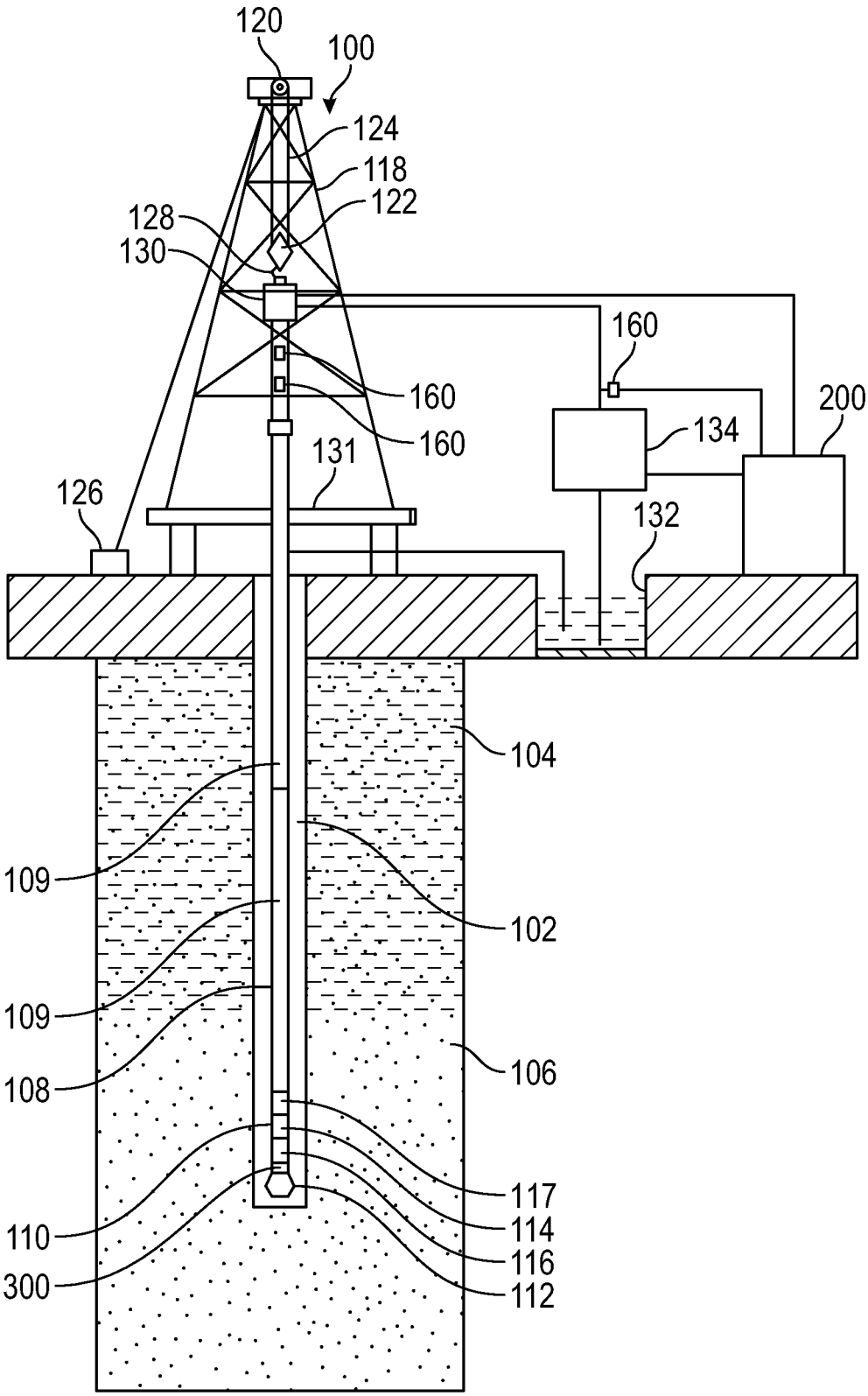
FIG. 1 shows an exemplary well site in accordance with one or more embodiments.

In the following detailed description, certain specific details are set forth to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures. As used herein, the term "coupled" or "coupled to" or "connected" or "connected to" "attached" or "attached to" may indicate establishing either a direct or indirect connection, and is not limited to either unless expressly referenced as such. As used herein, fluids may refer to slurries, liquids, gases, and/or mixtures thereof. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure.

Embodiments disclosed herein are directed to a downhole sub for releasing of one or more mobile devices in a downhole environment. More specifically, embodiments disclosed herein are directed to a downhole sub having a swappable housing, storing one or more mobile devices, and a control element made of dissolvable material for trigging the release of the one or more mobile devices from the housing in a downhole environment. The different embodiments described herein may provide a downhole sub in a bottom-hole assembly (BHA) of a drilling string during drilling operations for deployment of one or more mobile devices that plays a valuable and useful role in the life of a well.

By using the downhole sub for deployment of one or more mobile devices, the downhole sub may eliminate the need for deploying the one or more mobile devices from the surface and other costly surface facilities conventionally used in mobile device deployment. Further, a configuration and arrangement of the downhole sub to deploy the one or more mobile devices in the downhole environment according to one or more embodiments described herein may provide a cost-effective alternative to conventional methods. For example, one or more embodiments described herein may eliminate the need for costly surface facilities conventionally used in mobile device deployment operations. The embodiments are described merely as examples of useful applications, which are not limited to any specific details of the embodiments herein.

In accordance with one or more embodiments, a downhole sub includes a compartment extending a depth from an outer surface and a housing is removable fixed in the compartment. In one or more embodiments, the housing holds one or more mobile devices. Each of the mobile devices are a sensor encapsulated in a protective material. Further, a control element blocks an opening of the housing and is made of a dissolvable material configured to dissolve at a depth in a wellbore to release the one or more mobile devices into the downhole environment.

In conventional methods, downhole mobile devices are dropped from the surface at a top of a drill string to be carried by the flow of the drilling fluid to reach a bottom of the drill string at a bottom-hole assembly (BHA). Then, the downhole mobile devices continue flowing through drilling bit nozzles to an open-hole annulus, and then travel up with the drilling fluid flow to a cased-hole annulus, and finally, to surface where the downhole mobile devices are recovered for data download. The conventional method of deploying the downhole mobile devices give rise to a number of problems such as a significant portion of the downhole mobile devices' battery life can be lost before actually pass through the drilling bit to record data of in-situ conditions along the open-hole annulus. Another problem occurs in drilling sections with a small drill bit where the jet nozzles on the bit are small and may become blocked by the downhole mobile devices and be too big to pass through the jet nozzles. Additionally, an internal flow path restriction of the downhole mobile devices can also come from internal profiles of different BHA components and the drill string, as the downhole mobile devices may block the flow path of various fluids such as drilling fluids.

Advantageously, the downhole sub disclosed herein may deploy one or more mobile devices in a downhole environment without requiring surface equipment and avoid internal profiles of different BHA components and the drill string used in typical mobile devices deployment operations. Moreover, because the deployment of the one or more mobile devices occurs fully underground, the disclosed method deploys the one or more mobile devices into the annulus directly thereby eliminating the potential hazard of the one or more mobile devices getting stuck within the internal profiles of different BHA components and the drill string as well as enhance the battery life and electrical charging efficiency of the one or more mobile devices. Overall, the downhole sub disclosed herein may minimize product engineering, risk associated with surface equipment, reduction of assembly time, hardware cost reduction, and weight and envelope reduction. Thus, the disclosed the deployment methods of one or more mobile devices using the downhole sub improves safety on site and reduces cost associated with conventional mobile devices deployment operations.

FIG. 1 illustrates an exemplary well site 100. In general, well sites may be configured in a myriad of ways. Therefore, well site 100 is not intended to be limiting with respect to the particular configuration of the drilling equipment. The well site 100 is depicted as being on land. In other examples, the well site 100 may be offshore, and drilling may be carried out with or without use of a marine riser. A drilling operation at well site 100 may include drilling a wellbore 102 into a subsurface including various formations 104, 106. For the purpose of drilling a new section of wellbore 102, a drill string 108 is suspended within the wellbore 102.

The drill string 108 may include one or more drill pipes 109 connected to form conduit and a bottom hole assembly (BHA) 110 disposed at the distal end of the conduit. The BHA 110 may include a drill bit 112 to cut into the subsurface rock. The BHA 110 may also include various directional drilling tools and wellbore expanders, such as a mud motor 116 and a reamer 117, to direct the path at which the drill bit 112 cuts into the subsurface rock. The BHA 110 may further include measurement tools 114, such as a measurement-while-drilling (MWD) tool and logging-while-drilling (LWD) tool. The measurement tools 114 may include sensors and hardware to measure downhole drilling parameters, and these measurements may be transmitted to the surface using any suitable telemetry system known in the art. The BHA 110 and the drill string 108 may include other drilling tools known in the art but not specifically shown.

In one or more embodiments, the BHA 110 also includes a downhole sub 300 to deploy one or more mobile device within the wellbore 102. The downhole sub 300 may be located at various positions along the BHA 110. For example, the downhole sub 300 may be positioned above the drill bit 112 and coupled between the drill bit 112 and the mud motor 116. At the position between the drill bit 112 and the mud motor 116, the downhole sub 300 deploys one or more mobile devices to measure an area of the wellbore 102 near the drill bit 112. Additionally, this position of the downhole sub 300 eliminates the risks associated with the one or more mobile devices passing through the tight spots in the wellbore 102 where downhole tools, such as the reamer 117, are normally mounted next to the mud motor 116. Alternatively, the downhole sub 300 or a second downhole sub may be positioned above the mud motor 116, the measurement tools 114, or the reamer 117.

The one or more mobile devices are stored in a housing removably coupled to the downhole sub 300. From the housing, the downhole sub 300 will deploy the one or more mobile devices into the wellbore 102 at a predetermined depth to record and transmit various downhole measurements. To deploy the one or more mobile devices, the downhole sub 300 includes a control element made of a dissolvable material. Initially, the control element blocks an opening of the housing storing the one or more mobile devices. Once the downhole sub 300 reaches the predetermined depth, the control element dissolves to no longer block the opening of the housing such that the one or more mobile devices are deployed into the downhole environment of the wellbore 102. In a non-limiting example, the predetermined depth may be a bottom of a section of the wellbore 102 that is finished drilling to maximize a covered path of a logging operation. Alternately, the predetermined depth may be a depth of downhole interests both in terms of positions and time domain events, such as a tight spot, loss circulation, stuck pipe, drill pipe leakage, casing leakage, cementing, or various other downhole points. In some embodiments, the control element is made of a dissolvable material tailored by adjusting chemical compositions, processing and surface modifications, dissolvable material grades, or thickness to produce a dissolving rate specific to downhole conditions at the predetermined depth.

In one or more embodiments, the one or more mobile devices are stored in the housing in a standby mode while the downhole sub 300 is run downhole. The one or more mobile devices may be taken out of standby mode to record and transmit various downhole measurements in a variety of techniques. For example, the one or more mobile devices may have a time delay to time and sync the one or more mobile devices to exit out of standby mode when the downhole sub 300 reaches the predetermined depth. Additionally, a temperature measurement may be used to take the one or mobile devices out of standby mode by determining the moment of deployment through detecting a temperature change. Further, the one or mobile devices may exit standby mode through a change of motion, such as, the one or more mobile devices accelerating.

The drill string 108 may be suspended in wellbore 102 by a derrick 118. A crown block (120) may be mounted at the top of the derrick 118, and a traveling block 122 may hang down from the crown block 120 by means of a cable or drilling line 124. One end of the cable 124 may be connected to a drawworks 126, which is a reeling device that may be used to adjust the length of the cable 124 so that the traveling block 122 may move up or down the derrick 118. The traveling block 122 may include a hook 128 on which a top drive 130 is supported.

The top drive 130 is coupled to the top of the drill string 108 and is operable to rotate the drill string 108. Alternatively, the drill string 108 may be rotated by means of a rotary table (not shown) on the drilling floor 131. Drilling fluid (commonly called mud) may be stored in a mud pit 132, and at least one pump 134 may pump the mud from the mud pit 132 into the drill string 108. The mud may flow into the drill string 108 through appropriate flow paths in the top drive 130 (or a rotary swivel if a rotary table is used instead of a top drive to rotate the drill string 108).

In one implementation, a system 200 may be disposed at or communicate with the well site 100. System 200 may control at least a portion of a drilling operation at the well site 100 by providing controls to various components of the drilling operation. The System 200 may be a computing system, as described in FIG. 8. In one or more embodiments, system 200 may receive data from the one or more mobile devices deployed from the downhole sub 300 and one or more sensors 160 arranged to measure controllable parameters of the drilling operation. As a non-limiting example, the one or more mobile devices and the one or more sensors 160 may be arranged to measure WOB (weight on bit), RPM (drill string rotational speed), GPM (flow rate of the mud pumps), and ROP (rate of penetration of the drilling operation).

The one or more sensors 160 may be positioned to measure parameter(s) related to the rotation of the drill string 108, parameter(s) related to travel of the traveling block 122, which may be used to determine ROP of the drilling operation, and parameter(s) related to flow rate of the pump 134. For illustration purposes, the one or more sensors 160 are shown on drill string 108 and proximate mud pump 134. The illustrated locations of the one or more sensors 160 are not intended to be limiting, and the one or more sensors 160 could be disposed wherever drilling parameters need to be measured. Moreover, there may be many more sensors 160 than shown in FIG. 1 to measure various other parameters of the drilling operation. Each sensor 160 may be configured to measure a desired physical stimulus.

During a drilling operation at the well site 100, the drill string 108 is rotated relative to the wellbore 102, and weight is applied to the drill bit 112 to enable the drill bit 112 to break rock as the drill string 108 is rotated. In some cases, the drill bit 112 may be rotated independently with a drilling motor. In further embodiments, the drill bit 112 may be rotated using a combination of the drilling motor and the top drive 130 (or a rotary swivel if a rotary table is used instead of a top drive to rotate the drill string 108). While cutting rock with the drill bit 112, mud is pumped into the drill string 108.

The mud flows down the drill string 108 and exits into the bottom of the wellbore 102 through nozzles in the drill bit 112. The mud in the wellbore 102 then flows back up to the surface in an annular space between the drill string 108 and the wellbore 102 with entrained cuttings. The mud with the cuttings is returned to the pit 132 to be circulated back again into the drill string 108. Typically, the cuttings are removed from the mud, and the mud is reconditioned as necessary, before pumping the mud again into the drill string 108. In one or more embodiments, the drilling operation may be controlled by the system 200.

Figure 2A:
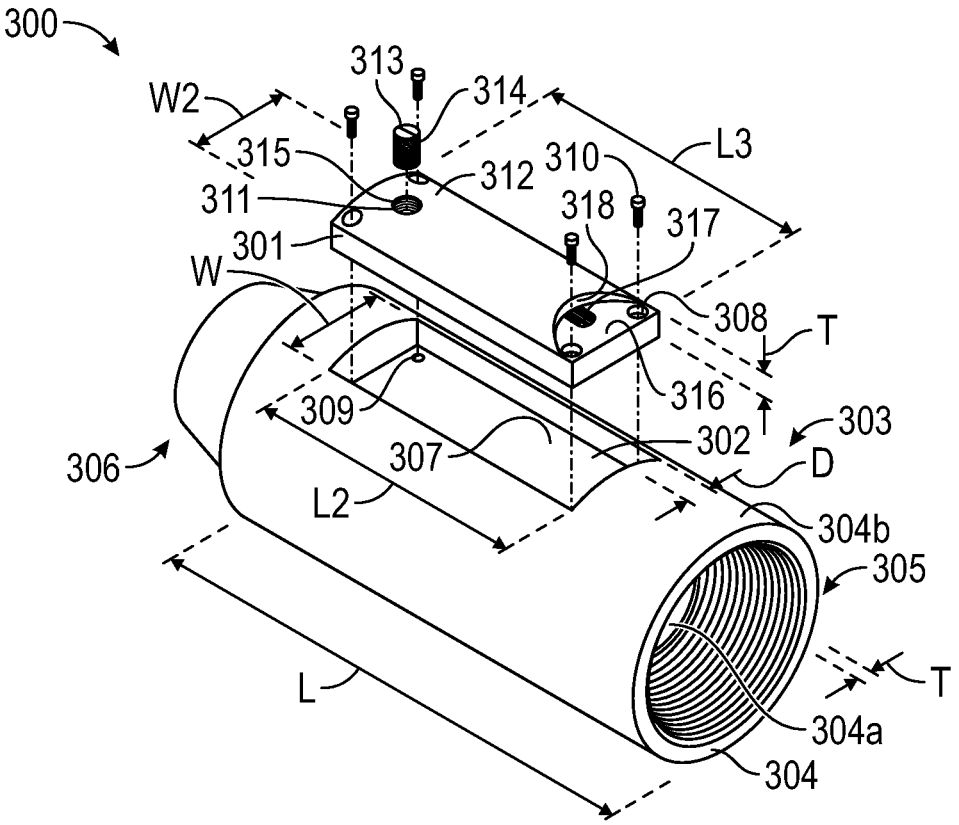
FIGS. 2A and 2B show a perspective view of a downhole sub in accordance with embodiments disclosed herein.

Referring to FIG. 2A, the downhole sub 300 in accordance with embodiments disclosed herein is illustrated. For illustration purposes, the downhole sub 300 is shown in an exploded view to illustrate a housing 301 and a compartment 302. the downhole sub 300 includes a body 303 defined by a wall 304 extending a length L in an axial direction from a first end 305 to a second end 306. The first end 305 and the second end 306 are connection ends to allow the downhole sub 300 to be coupled to various components in the BHA (for example, the drill bit, the directional drilling tool, or any tools in the BHA). Additionally, an inner surface 304*a* of the wall 304 defines a flow path through the downhole sub 300 and an outer surface 304*b* of the wall 304 defines an outer diameter of the downhole sub 300.

In one or more embodiments, the compartment 302 extends a depth D from the outer surface 30*b* into the wall 304. The depth D of the compartment 302 is less than a thickness T of the wall 304. For example, the depth D of the compartment 302 may be within the range of a minimal value that allows for storing one or more mobile devices (320) and a maximum value with which a minimum cavity bottom wall is required to maintain a structural integrity of the downhole sub 300. The depth D of the compartment 302 may have a value above 5 mm and below the thickness T of the wall 304. In some embodiments, the depth D of the compartment 302 may be based on half of the thickness T of the wall 304 (for example, the depth D of the compartment 302 may be determined by ½*(Outer Diameter−Inner Diameter)). Additionally, the compartment 302 also extends a length L2 in the axial direction shorter than the length L of the wall 304. Further, the compartment 302 also extends a width W in a radial direction. The compartment 302 may be milled vertically from a side of the downhole sub 300 with the width W and the length L2. For example, the width W may be determined by a needed size of the compartment 302 and a size limitation of the downhole sub 300. The width W may have a value of above 5 mm and below the outer diameter of downhole sub 300.

As shown in FIG. 2A, the housing 301 may have a dimensional profile matching a dimensional profile of the compartment 302 to have the housing 301 fit into the compartment 302. For example, the housing 301 may have a thickness T2 equal to the depth D of the compartment 302, a length L3 equal to the length L2 of the compartment 302, and a width W2 equal to the width W of the compartment 302. While it is noted that the housing 301 and the compartment 302 are shaped in a rectangle, this is merely for example purposes, and the housing 301 and the compartment 302 may be in any shape without departing from the present scope of the disclosure.

In one or more embodiments, the housing 301 includes one or more connection points 308 aligned with one or more connection points 309 on a surface 307 of the compartment 302. For example, the one or more connection points 308, 309 may be holes for a mechanical fastener 310 (for example, a bolt, nail, or screw) to removably fix the housing 301 within the compartment 302. Alternatively, a magnet or adhesive may be used to removably fix the housing 301 within the compartment 302.

Still referring to FIG. 2A, the housing 301 includes an opening 311 on a top surface 312. A control element 313 is shaped to be inserted into the opening 311. For example, the control element 313 may be in the form of a plug to fit within and close the opening 311. Additionally, a connection surface 314 of the control element 313 is coupled to a connection surface 315 within the opening 311. Both connection surfaces 314, 315 may be threaded connections.

The control element 313 is made of a dissolvable material with metallic or non-metallic based materials. The metallic dissolvable material may be a magnesium based alloy or an aluminum based alloy. The non-metallic dissolvable material may be polyglycolic acid (PGA), polylactic acid (PLA), or polyurethane (PU). One skilled in the art will appreciate how the dissolvable materials may be tailored by adjusting the chemical compositions, processing and surface modifications to produce a dissolving rate of the control element 313 in specific downhole conditions at the predetermined depth. It is further envisioned that the control element 313 may be made of different dissolvable material grades, thickness, or surface modifications to achieve a targeted deployment timing of the one or more mobile devices at the predetermined depth due to different downhole conditions.

In some embodiments, at an end opposite the opening 311, the housing 301 may include a cutout portion 316 recessed lower than the top surface 312. In the cutout portion 316, a fluid inlet 317 is provided to allow fluid to flow into the housing 301 to aid in deploying the one or more mobile devices out of the opening 311. Additionally, a ledge 318 may be formed between the top surface 312 and the cutout portion 316. The ledge 318 may form a back stop for fluids to buildup and flow into the fluid inlet 317.

Figure 2B:
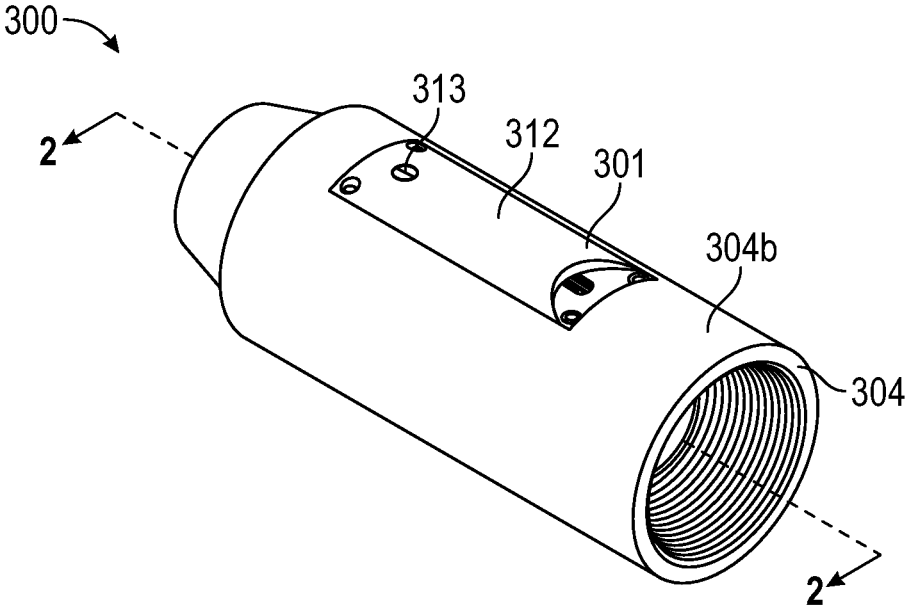

Now referring to FIG. 2B, the downhole sub 300 is illustrated with the housing 301 removably fixed in the compartment 302 and the control element 313 inserted into the opening 311. The housing 301 fits into the compartment 302 such that the top surface 312 of the housing 301 is flush with the outer surface 304*b* of the wall 304. Additionally, the top surface 312 may be curved to match the cylindrical shape of the downhole sub 300.

Figure 2C:
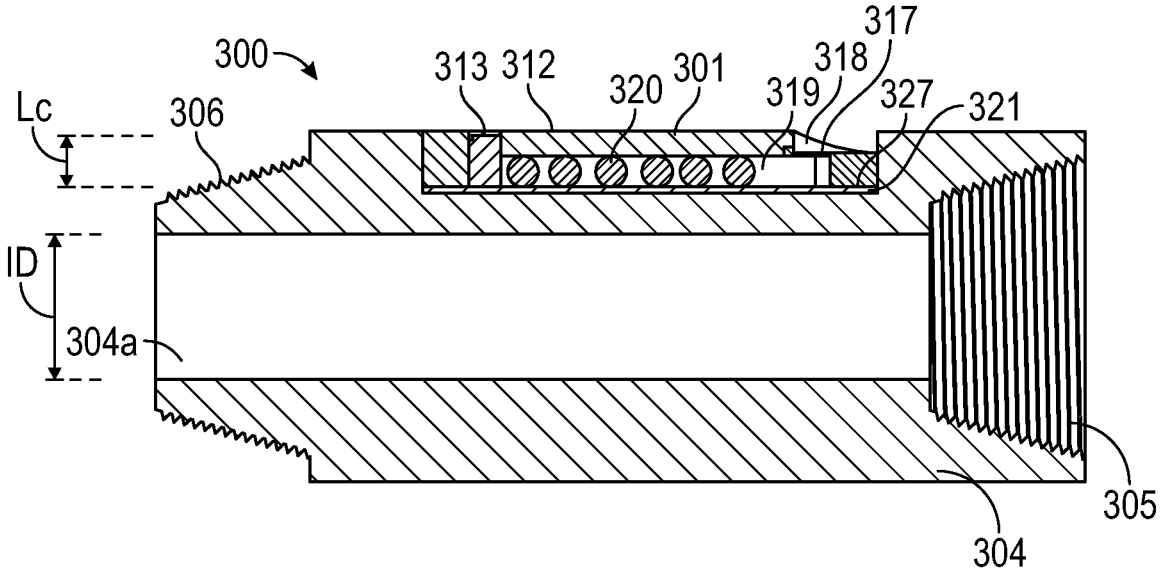
FIGS. 2C and 2D show a cross-sectional view taken along line 2-2 of FIG. 2B in accordance with embodiments disclosed herein.
Figure 2D:
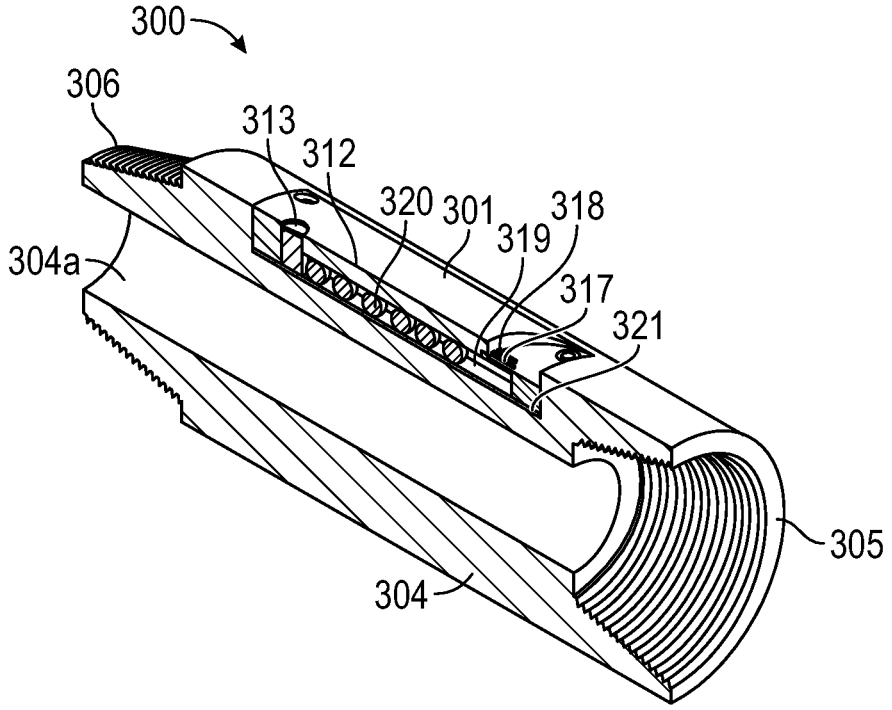

In FIGS. 2C and 2D, a cross-sectional view of the downhole sub 300 taken along line 2-2 in FIG. 2B is illustrated. The first end 305 may be a box threaded connection and second end 306 may be a pin threaded connection. The inner surface 304*a* of the wall 304 may have an inner diameter ID to allow fluids (for example, drilling fluids such as mud) travel through the flow path of the downhole sub 300.

In one or more embodiments, the housing 301 includes a storage compartment 319 to store one or more mobile devices 320. The one or more mobile devices 320 may be disposed in the storage compartment 319 via a bottom surface 327 of the housing 301. The storage compartment 319 may be sealed by the top surface 312 and a back lid 321. Additionally, the storage compartment 319 is fluidly coupled to the fluid inlet 317 such that fluids flow into the storage compartment from the fluid inlet 317. For example, fluids are guided to the fluid inlet 317 via the ledge 118 to flow into the storage compartment 319.

As shown in FIG. 2C, the control element 313 has a length Lc to seal against the back lid 321 to close off the storage compartment 319. When fully inserted, the control element 313 is slightly below the top surface 312 to avoid contacting the wellbore preventing damage to the control element 313 which may result in deploying the one or more mobile devices 320 before the predetermined depth is reached.

In some embodiments, each of the one or more mobile devices 320 is a sensor encapsulated in a protective material. The protective material may be a polymer based composite material, epoxy material, or a combination thereof. The one or more mobile devices 320 may be in various shaped in various profiles (for example, spherical, pill, bullet, and other shapes) and sizes (for example, submillimeter to tens and up to a few hundred millimeters in diameter) to fit within the storage compartment 319. Additionally, the one or more mobile devices 320 are compact, lightweight, and stand-alone systems, with millimeter-range footprint, that are used to collect downhole in-situ data respective to the sensor encapsulated in the protective material. For example, the sensors embodied as the one or more mobile devices 320 may be acoustic sensors, pressure sensors, vibration sensors, accelerometers, gyroscopic sensors, magnetometer sensors, and temperature sensors. The one or more mobile devices 320 measure/collect downhole measurements such as wellbore directional survey, temperature profile, or pressure profile to provide an inexpensive solution for taking measurements downhole. Additionally, the one or more mobile devices 320 are configured to transmit the collected downhole measurements to the surface without the need for additional trips into the wellbore for different types or for additional measurements. The collected downhole measurements may be used to analyze, control, monitor, and/or optimize aspects of the drilling operation and facilitate relevant decision-making in real-time.

In one or more embodiments, the one or more mobile devices 320 may be charged with the use of a powering unit within the downhole sub 300. For example, the housing 301 may include electronics for downhole charging and initiation of the one or more mobile devices 320. The electronics may include transmitter coil(s), control unit(s), and/or battery cell(s) to enable continuous charging (wired or wireless) of the one or more mobile devices 320 through a charging interface. The electronics may also include accelerometers and/or other sensors along with microcontrollers to trigger the initiation of the one or more mobile devices 320 to switch from standby (or sleep) mode to active (or on) mode which starts in-situ data collection.

Figure 3:
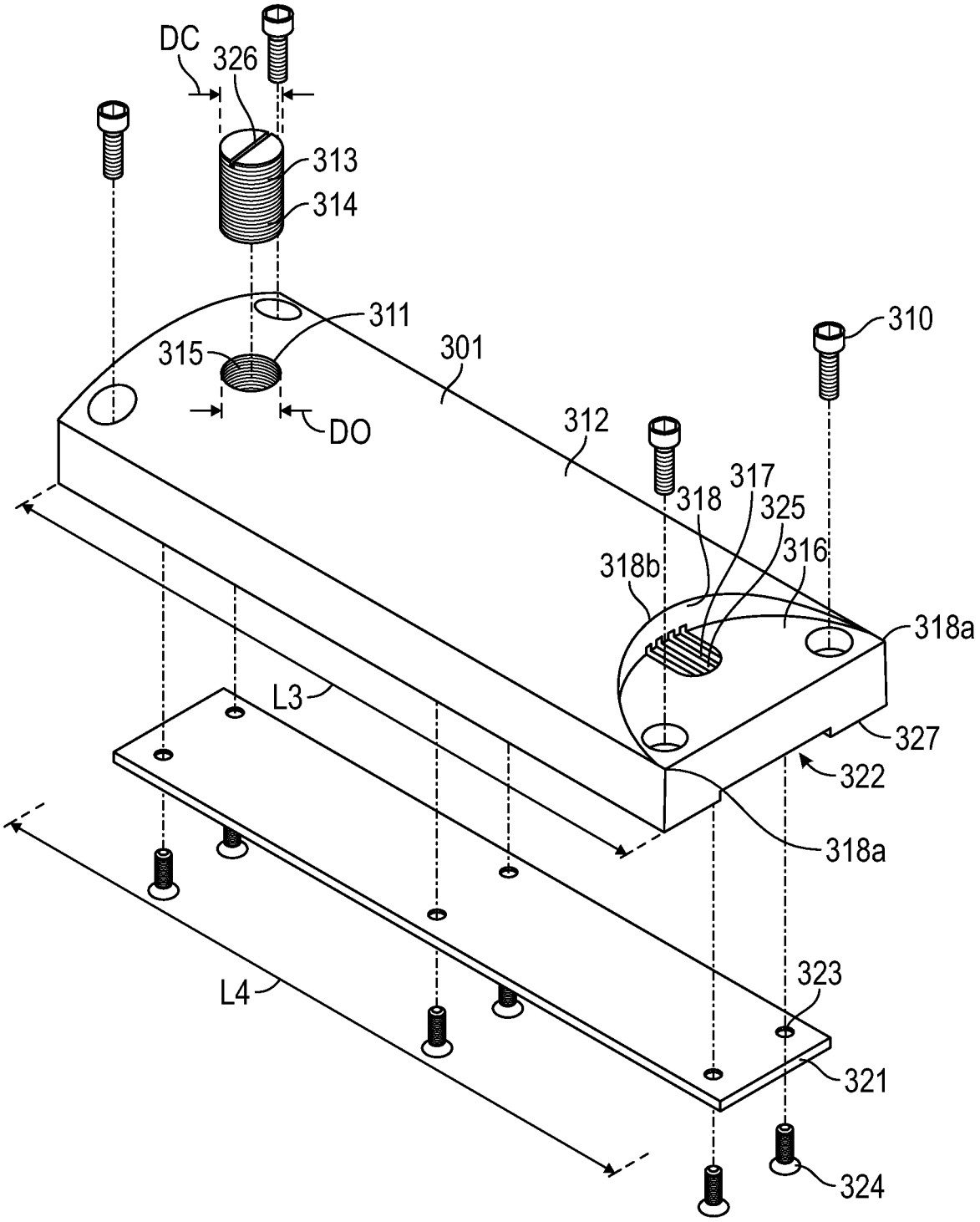
FIG. 3 shows a perspective view of a housing of the downhole sub of FIGS. 2A-2D in accordance with embodiments disclosed herein.

Now referring to FIG. 3, for illustration purposes, the housing 301 is shown in an exploded view. The back lid 321 may have a length L4 equal to the length L3 of the housing 301. Additionally, the housing 301 may have a slot 322 in the bottom surface 327 for the back lid 321 to fit into. The back lid 321 may include one or more connection holes 323 for a mechanical fastener 324 (for example, a bolt, nail, or screw) to removably fix the back lid 321 in the slot 322.

In one or more embodiments, the ledge 318 has a profile of a semicircular groove to guide fluid to the fluid inlet 318. The ledge 318 may progressively increase in size/width from ends 318*a* of the semicircular groove to a vertex 318*b* of the semicircular groove. For example, the ledge 318 may have a height equal to the cutout portion 316 at the ends 318*a* and progressively get bigger such that the height of the ledge 318 at the vertex 318*b* is equal to the top surface 312. Additionally, the fluid inlet 318 may extend from the cutout portion 316 to a portion of the ledge 318. Further, the fluid inlet 318 may include a filter 325 to prevent debris and solids from entering the storage compartment 319.

As shown in FIG. 3, the opening 311 may be circular with a diameter DO. Additionally, the control element 313 may be a plug with a cylindrical shape match the circular profile of the opening 311. For example, the control element 313 may have a diameter DC equal to the diameter DO of the opening 311 such that the control element 313 blocks the opening 311. Additionally, to insert and tighten the control element 313 in the opening 311, the control element 313 may include a torque connection 326, such as a drive or recess, for a torque tool to engage. For example, the torque connection 326 may be torqued to couple the connection surface 314 of the control element 313 to the connection surface 315 within the opening 311. Both connection surfaces 314, 315 may be threaded connections. Alternatively, both connection surfaces 314, 315 may be grated surfaces or sized to form a friction fit between the control element 313 and the opening 311.

Figure 4A:
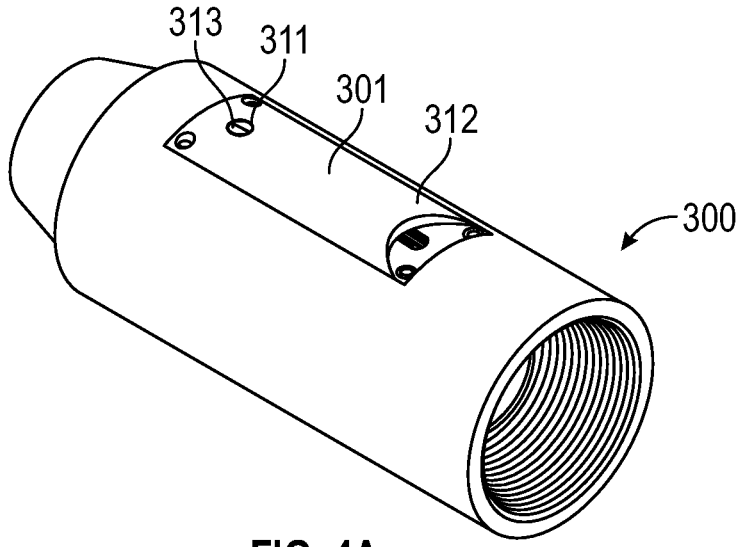
FIGS. 4A-4C show a perspective view of a workflow of the downhole sub of FIGS. 2A-3 in accordance with embodiments disclosed herein.
Figure 4B:
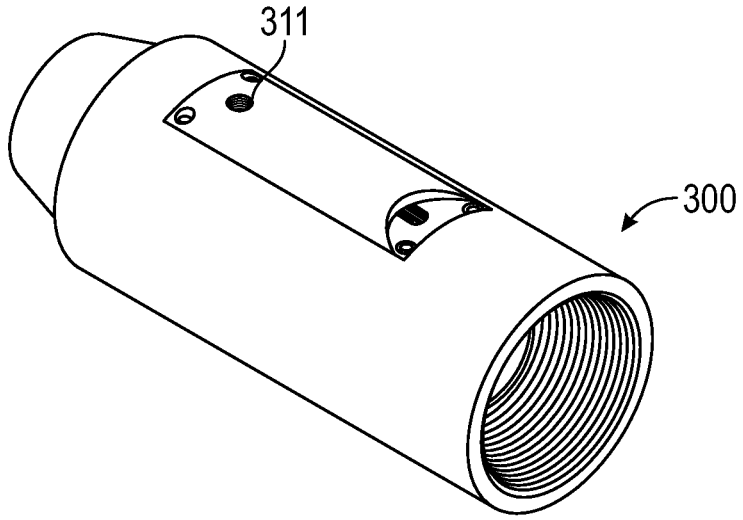
Figure 4C:
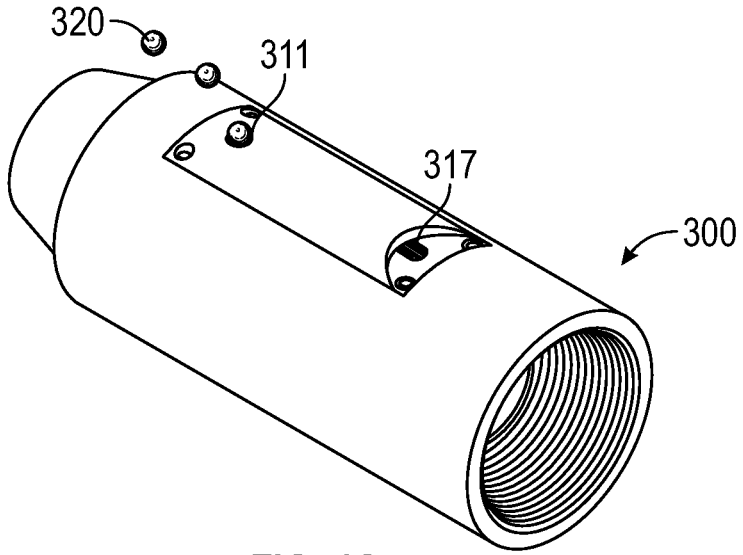

Now referring to FIGS. 4A-4C, a workflow of the downhole sub 300 described in FIGS. 2A-3 is illustrated. In FIG. 4A, the downhole sub 300 is assembled and run downhole in the wellbore. The assembly of the downhole sub 300 may take place at the surface. For example, the one or more mobile devices (320) may be placed in the storage compartment (319) and the back lid (321) is removably fixed in the slot (322) of the housing 301. Additionally, the control element 313 is inserted into the opening 311. Next, the housing 301 is removably fixed in the compartment (302) to fully assembly the downhole sub. Once the downhole sub 300 reaches the predetermined depth, the control element (313) dissolves to open the opening 311, as shown in the FIG. 4B. With the control element (313) dissolved, fluids may enter the storage compartment (319) of the housing 301 via the fluid inlet 317 and flow the one or more mobile devices 320 out of the opening 311, as shown in the FIG. 4C. The one or more mobile devices 320 are deployed directly into an annulus between the wellbore and BHA to record and transmit downhole measurements. From the annulus, drilling fluids may carry the one or more mobile devices 320 back to the surface.

Figure 5A:
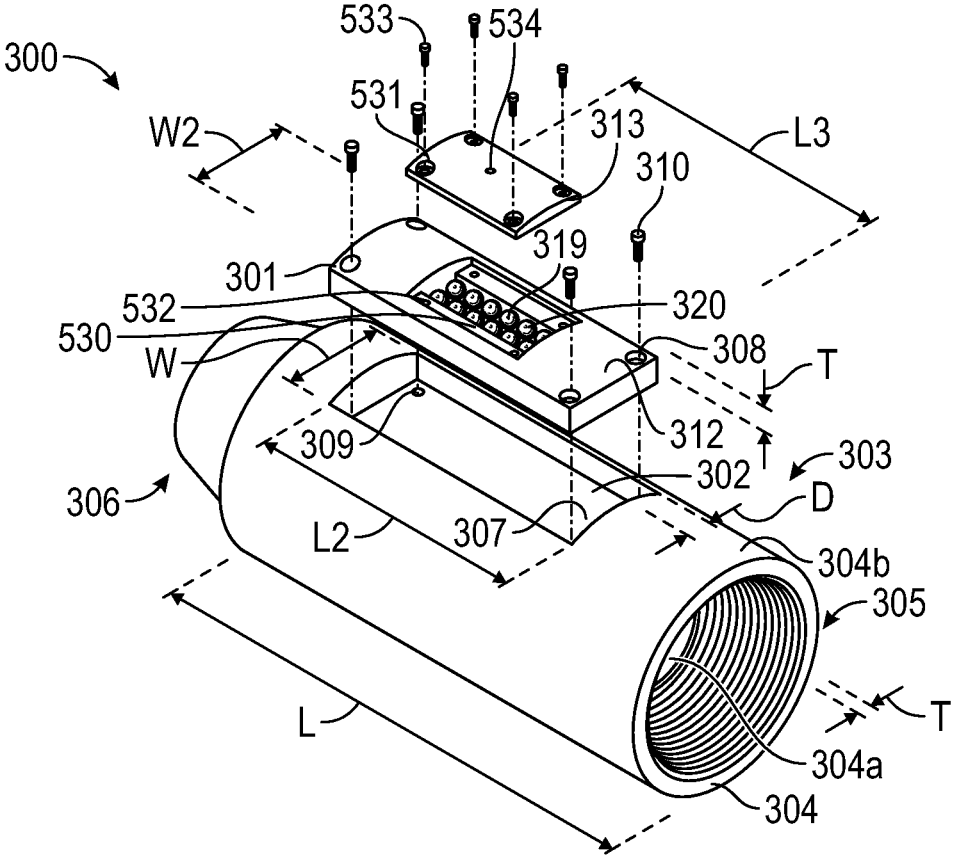
FIGS. 5A and 5B show a perspective view of a downhole sub in accordance with embodiments disclosed herein.

Now referring to FIG. 5A, another embodiment of the downhole sub 300 according to embodiments herein is illustrated, where like numerals represent like parts. The embodiment of FIG. 5A is similar to that of the embodiment of FIG. 2A. However, in the embodiment of FIG. 5A, the control element 313 may be a lid covering the storage compartment 319 of the housing 301 instead of being a plug inserted in the opening (311 of FIG. 2A). Additionally, the storage compartment 319 may include one or more steps 530 to delimit a storage space of the storage compartment 319 holding the one or more mobile devices 320. Further, the control element 313 includes one or more connection points 531 aligned one or more connection points 532 on the one or more steps 530. For example, the one or more connection points 531, 532 may be holes for a mechanical fastener 533 (for example, a bolt, nail, or screw) to couple the control element 313 within the storage compartment 319. Alternatively, a magnet or adhesive may be used to removably fix the control element 313 within the storage compartment 319. It is further envisioned that the control element 313 may include an equalization port 534 for pressure equalization at two sides of the control element 313 at any time.

Figure 5B:
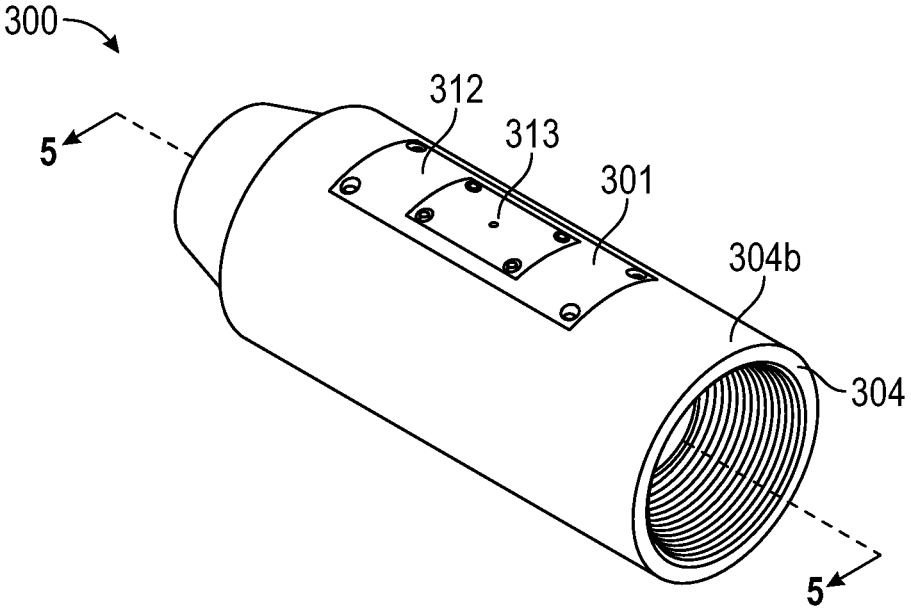

Now referring to FIG. 5B, the downhole sub 300 is illustrated with the housing 301 removably fixed in the compartment 302. Additionally, the control element 313 is inserted into the storage compartment 319 to be flush with the top surface 312 of the housing 301. The housing 301 fits into the compartment 302 such that the top surface 312 of the housing 301 is flush with the outer surface 304*b* of the wall 304. Additionally, the top surface 312 and the control element 313 may be curved to match the cylindrical shape of the downhole sub 300.

Figure 5C:
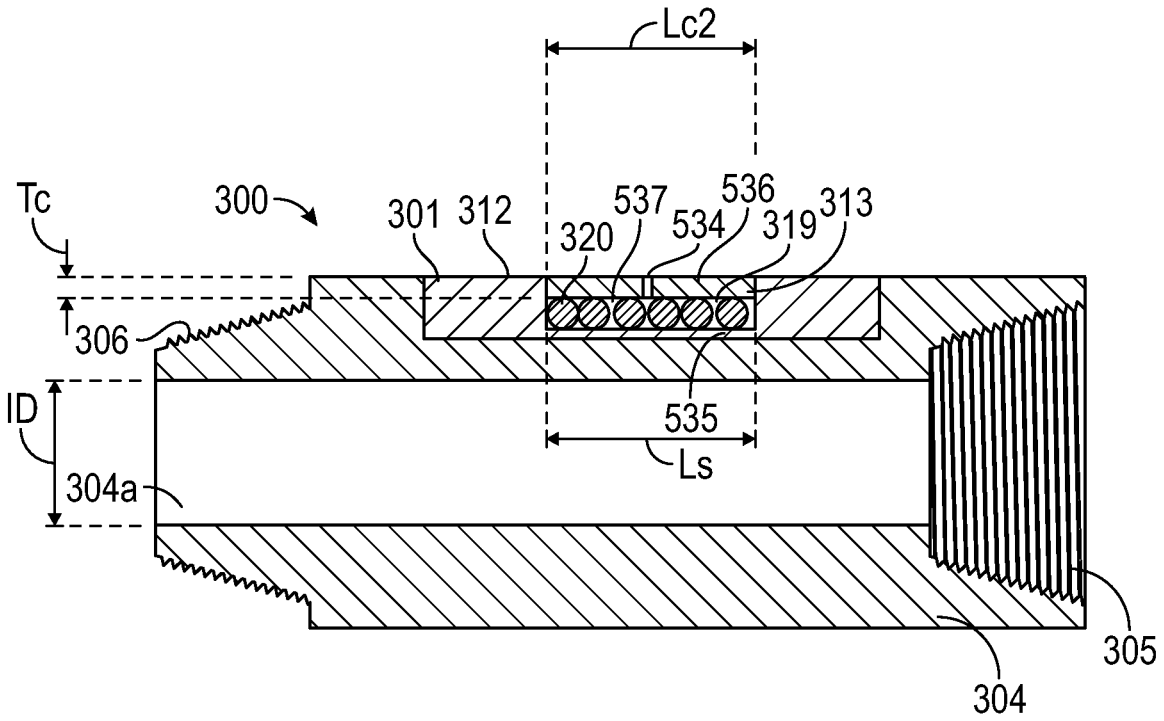
FIG. 5C shows a cross-sectional view taken along line 5-5 of FIG. 5B in accordance with embodiments disclosed herein.

In FIG. 5C, a cross-sectional view of the downhole sub 300 taken along line 5-5 in FIG. 5B is illustrated. The first end 305 may be a box threaded connection and second end 306 may be a pin threaded connection. The inner surface 304*a* of the wall 304 may have an inner diameter ID to allow fluids (for example, drilling fluids such as mud) travel through the flow path of the downhole sub 300. Additionally, the housing 301 includes the storage compartment 319 to store one or more mobile devices 320. The storage compartment 319 is delimited by the control element 313 and a bottom 535 of the housing 301.

As shown in FIG. 5C, the control element 313 has a length Lc2 equal to a length Ls of the storage compartment 319. When fully inserted, the control element 313 fully covers the storage compartment 319 to store the one or more mobile devices 320. Additionally, the control element 313 has a thickness Tc extending from a first surface to a second surface 537 which may be adjusted depending on the predetermined depth. The equalization port 534 may extend from the first surface 536 of the control element 313 to the second surface 537 of the control element 313. The equalization port 534 may be used for pressure equalization in the storage compartment 319 and outside of the control element 313.

Figure 6A:
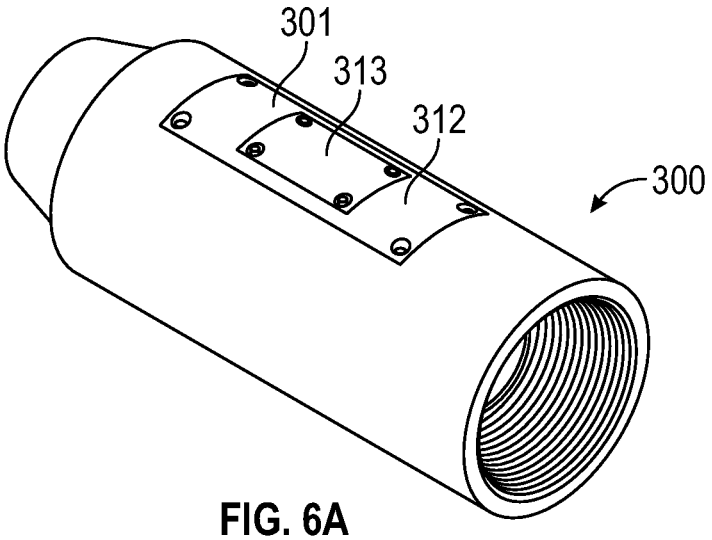
FIGS. 6A-6C show a perspective view of a workflow of the downhole sub of FIGS. 5A-5C in accordance with embodiments disclosed herein.
Figure 6B:
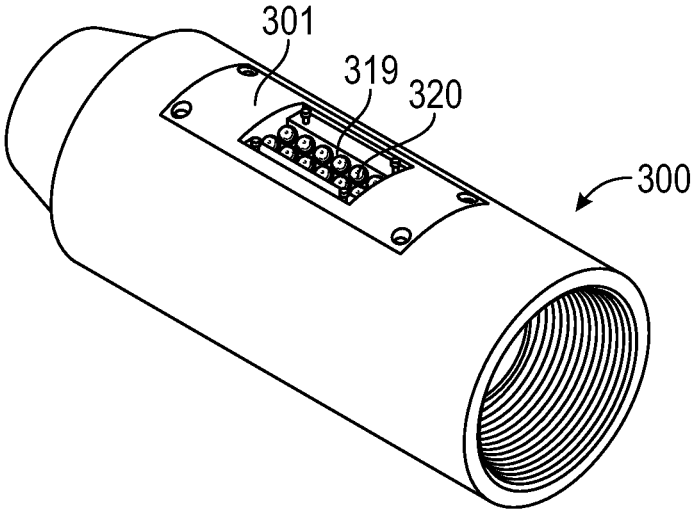
Figure 6C:
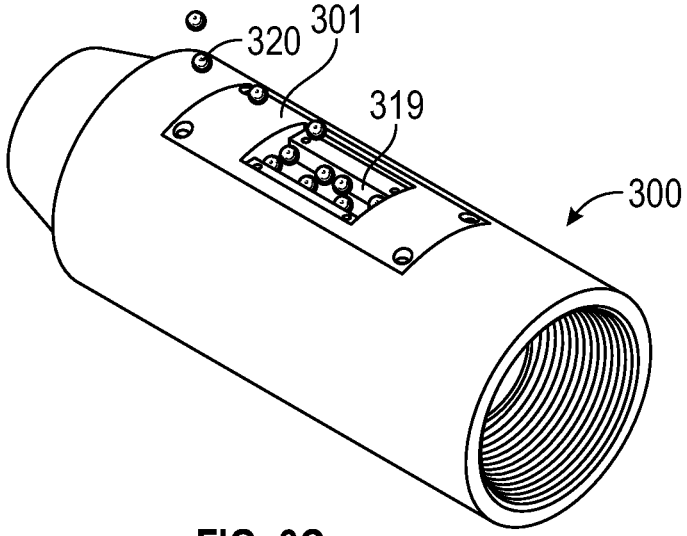

Now referring to FIGS. 6A-6C, a workflow of the downhole sub 300 described in FIGS. 5A-5C is illustrated. In FIG. 6A, the downhole sub 300 is assembled and run downhole in the wellbore. The assembly of the downhole sub 300 may take place at the surface. For example, the one or more mobile device (320) may be placed in the storage compartment (319) and the control element 313 is removably fixed in the storage compartment (319) to close in the one or more mobile device (320). Next, the housing 301 removably fixed in the compartment (302) to fully assembly the downhole sub. Once the downhole sub 300 reaches the predetermined depth, the control element 313 dissolves, to open the storage compartment 319 and expose the one or more mobile devices 320, as shown in FIG. 6B. With the control element 313 dissolved, the one or more mobile devices 320 are deployed directly into an annulus between the wellbore and BHA to record and transmit downhole measurements, as shown in the FIG. 6C. In one or more embodiments, the control element may dissolve, trigging the release of the mobile devices, at a set time and set downhole environment. From the annulus, drilling fluids may carry the one or more mobile devices 320 back to the surface via back flow, for example.

Figure 9:
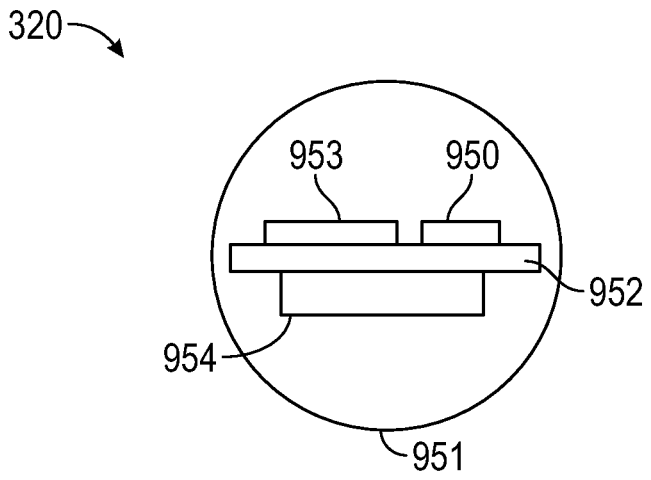
FIG. 9 shows a cross-sectional view of one or more mobile devices in accordance with embodiments disclosed herein.

Now referring to FIG. 9, a cross sectional view of the one or more mobile devices 320 is illustrated. The one or more mobile devices 320 are sensors 950 encapsulated in a protective material 951. The protective material 951 may be a polymer based composite material, epoxy material, or a combination thereof. The protective material 951 may form a shell in the shape of sphere. However, the shape of the shell may have various profiles (for example, spherical, pill, bullet, and other shapes) and sizes (for example, submillimeter to tens and up to a few hundred millimeters in diameter) to fit within the storage compartment (319). Additionally, the one or more mobile devices 320 are compact, lightweight, and stand-alone systems, with millimeter-range footprint, that are used to collect downhole in-situ data respective to the sensor 950 encapsulated in the protective material 951. The sensor 950 embodied as the one or more mobile devices 320 may be acoustic sensors, pressure sensors, vibration sensors, accelerometers, gyroscopic sensors, magnetometer sensors, and temperature sensors. Further, within the protective material 951, the sensor 950 may be provided on a printed circuit board 952. Additionally, a microprocessor 953 and a battery 954 may be in communication with the sensor 950 via the printed circuit board 952.

Figure 10:
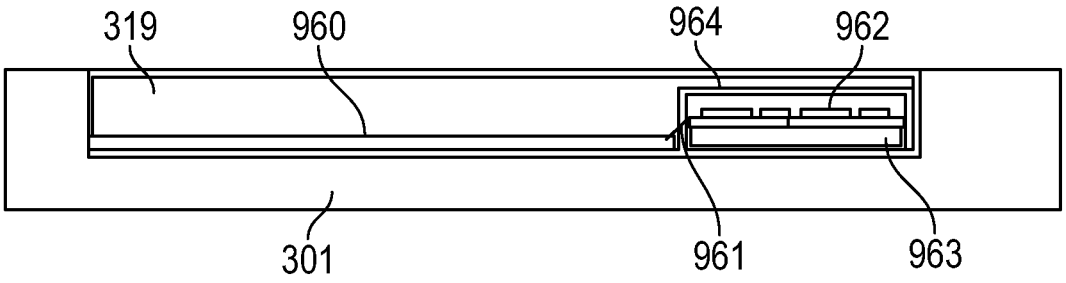
FIG. 10 shows a cross-sectional view of housing in accordance with embodiments disclosed herein.

Now referring to FIG. 10, a cross sectional view of the housing 301 without the one or more mobile devices (320) is illustrated. In the storage compartment 319, the housing 301 may include a charging pad 960 to charge the one or more mobile devices (320). For example, the one or more mobile devices (320) may be directly contacting the charging pad 960 to receive a charge. Additionally, an electronic connection 961 may connect the charging pad 960 to a circuit 962 and a battery 963 for charging and initiation of the one or more mobile devices (320). The circuit 962 and the battery 963 may be hermetically sealed in a separate compartment 964 from the storage compartment 319 containing the charging pad 960. By hermetically sealing the circuit 962 and the battery 963 in the separate compartment 964, fluids are prevented from damaging the circuit 962 and the battery 963. The charging pad 960, the electronic connection 961, the circuit 962, and the battery 963 may form a power unit to enable continuous charging (wired or wireless) of the one or more mobile devices (320) and trigger the initiation of the one or more mobile devices (320) to switch from standby (or sleep) mode to active (or on) mode which starts in-situ data collection.

Figure 7:
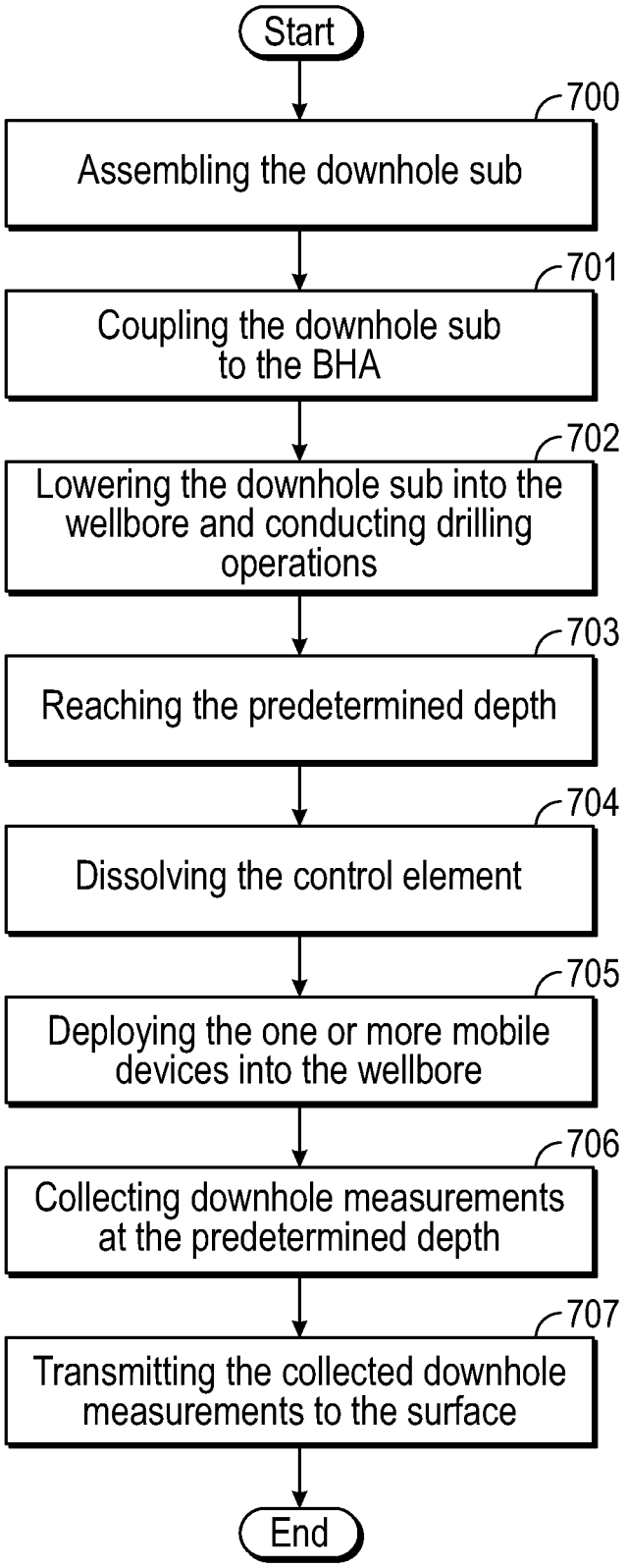
FIG. 7 is a flow chart of a method in accordance with embodiments disclosed herein.

FIG. 7 is a flowchart showing a method for deploying the one or more mobile devices using the downhole sub 300 described in FIGS. 1-6C, 9, and 10. One or more blocks in FIG. 2 may be performed by one or more components, such as, a computing system coupled to a controller in communication with the downhole sub 300. For example, a non-transitory computer readable medium may store instructions on a memory coupled to a processor such that the instructions include functionality for operating the downhole sub 300. While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 700, the downhole sub is assembled. To assemble the downhole sub, the one or more mobile devices are disposed into the storage compartment of the housing. For example, the one or more mobile devices may be placed into the storage compartment from the bottom surface of the housing, the back lid is removably fixed to the slot in the bottom surface, and the control element (in the form of a plug) is inserted into the opening in the top surface to seal the one or more mobile devices in the storage compartment. Alternatively, the one or more mobile devices may be placed into the storage compartment from the top surface of the housing and the control element (in the form of a lid) is inserted into the storage compartment to seal the one or more mobile devices in the storage compartment. Additionally, the one or more mobile devices may be directly contacting a charging pad in the storage compartment. Further, when the one or more mobile devices are disposed in the storage compartment, the one or more mobile devices are in a standby mode. With the one or more mobile devices sealed in the storage compartment, the housing is removably fixed within the compartment to fully assemble the downhole sub.

In Block 701, the downhole sub is coupled to the BHA. For example, the downhole sub is coupled to the components of the BHA to be position axially above the drill bit of the BHA. In one or more embodiments, the downhole sub may directly be coupled to the drill bit or be axially spaced above the drill bit. With the BHA formed, the drill string may be coupled to the BHA to lower the BHA into the well and drill the formation to form the wellbore. In one or more embodiments, the downhole sub is mounted on a nozzle which may be used for any drilling bit without customized bit manufacturing.

In Block 702, with the downhole sub assembled and coupled the BHA, the downhole sub is lowered into the wellbore via the drill sting and drilling operations are conducted at the well site. For example, the drill string is rotated, and weight is applied to the drill bit to enable the drill bit to drill the formation as the drill string is rotated. In some cases, the drill bit may be rotated independently of the drill string. While drilling the formation, mud is pumped into the drill string and out the drill bit to flow cutting up the annulus between the wellbore and drill string to reach the surface. Furthermore, as the downhole sub is lowered, the one or more mobile devices are continuously charging via the charging pad that is being powered by the circuit and the battery through the electronic connection.

In Block 703, with the drilling operations taking place, the downhole sub will reach a predetermined depth in the wellbore. For example, the predetermined depth may be a bottom of a section of the wellbore or a depth of downhole interest both in terms of positions and time domain events, such as a tight spot, loss circulation, stuck pipe, drill pipe leakage, casing leakage, cementing, or various other downhole points.

In Block 704, with the downhole sub at the predetermined depth, the control element dissolves. For example, once the control element is exposed to the downhole conditions at the predetermined depth, the control element dissolves to open the storage compartment. The control element is made of a dissolvable material tailored by adjusting chemical compositions, processing and surface modifications, dissolvable material grades, and/or thickness to produce a dissolving rate specific to downhole conditions at the predetermined depth. In alternate embodiments, the control element on the downhole sub may dissolve based on a timed event, such as a timer that is affixed to the downhole sub.

In Block 705, after the control element is dissolved, the one or more mobile devices are deployed into the wellbore. For example, the one or more mobile devices exit the storage compartment to release directly into the annulus between the wellbore and drill string. In some embodiments, fluids enter the storage compartment via the fluid inlet and flow out the one or more mobile devices through the opening in the top surface of the housing. Alternatively, the one or more mobile devices may flow directly out of the storage compartment without needing fluid to push out the one or more mobile devices.

In Block 706, the one or more mobile devices start to measure and/or collect downhole measurements at the predetermined depth. To collect downhole measurements, the one or more mobile devices are taken out of standby mode to be turned on to record and collect the downhole measurements. For example, the one or more mobile devices may have a time delay to time and sync the one or mobile devices to be taken out of standby mode when the downhole sub reaches the predetermined depth. Additionally, by determining the moment of deployment through detecting a temperature change (for example, the downhole temperature relative to the temperature in the storage compartment), a temperature measurement may be used to take the one or more mobile devices out of standby mode. Further, the one or mobile devices may be taken out of standby mode through a change of motion, such as, when the one or more mobile devices are accelerating out of the storage compartment.

In Block 707, the one or more mobile devices transmits the collected downhole measurements to the surface to analyze, control, monitor, and/or optimize aspects of the drilling operation and facilitate relevant decision-making based on the collected downhole measurements. For example, the one or more mobile devices may include telemetry to transmit the collected downhole measurements to the surface in real-time. Additionally, the one or more mobile device may include a memory to store the collected downhole measurements. With the collected downhole measurements stored on the one or more mobile device, drilling fluids may be pumped down the drill string and exit the BHA into the annulus. In the annulus, the drilling fluids continue to flow upward and into a drilling fluid reservoir at the surface. The drilling fluids will carry the one or more mobile devices to the surface for collection. Upon collecting the one or more mobile devices at the surface from the drilling fluid reservoir, the stored collected downhole measurements may be uploaded for analyzation.

In addition to the benefits described above, the downhole sub may improve an overall efficiency and performance of drilling operations while reducing cost and risk of non-productive time (NPT), and many other advantages. Further, the downhole sub may provide further advantages such as being able to deploy the one or more mobile devices directly into the annulus, avoid costly fishing operations as the one or more mobile devices does not travel through the drill bit and other BHA components, being used in drilling operations that require small bit nozzles sizes that cannot have the one or more mobile devices pass through, and is not limited to any type of well operations (for example, drilling, well testing and surveying, hydraulic fracturing, workover, and completions on either offshore or land rigs).

Figure 8:
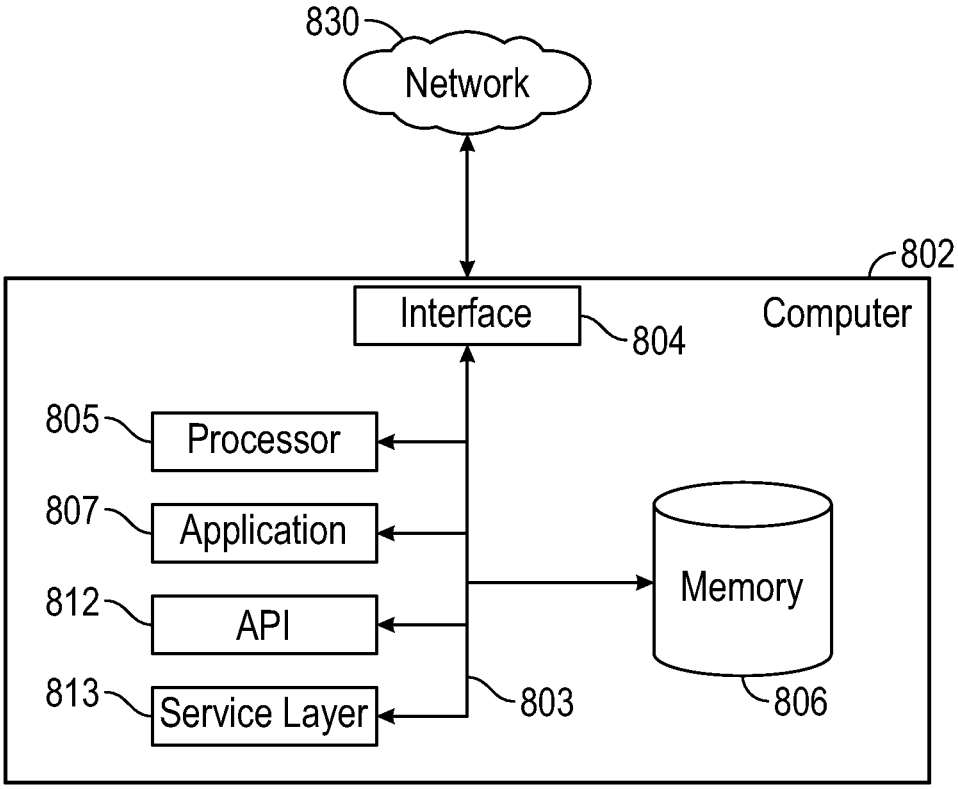
FIG. 8 is a schematic diagram of a computing system in accordance with embodiments disclosed herein.

Embodiments may be implemented on a computer system. FIG. 8 is a block diagram of a computer system 802 used to provide computational functionalities associated with described downhole sub 300, methods, functions, processes, flows, and procedures as described in the instant disclosure, according to an implementation. The illustrated computer 802 is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 802 may include a computer that includes an input device, such as a keypad, keyboard, touch screen, or other device that can accept user information, and an output device that conveys information associated with the operation of the computer 802, including digital data, visual, or audio information (or a combination of information), or a GUI.

The computer 802 can serve in a role as a client, network component, a server, a database or other persistency, or any other component (or a combination of roles) of a computer system for performing the subject matter described in the instant disclosure. The illustrated computer 802 is communicably coupled with a network 830. In some implementations, one or more components of the computer 802 may be configured to operate within environments, including cloud-computing-based, local, global, or other environment (or a combination of environments).

At a high level, the computer 802 is an electronic computing device operable to receive, transmit, process, store, or manage data and information associated with the described subject matter. According to some implementations, the computer 802 may also include or be communicably coupled with an application server, e-mail server, web server, caching server, streaming data server, business intelligence (BI) server, or other server (or a combination of servers).

The computer 802 can receive requests over network 830 from a client application (for example, executing on another computer 802) and responding to the received requests by processing the said requests in an appropriate software application. In addition, requests may also be sent to the computer 802 from internal users (for example, from a command console or by other appropriate access method), external or third-parties, other automated applications, as well as any other appropriate entities, individuals, systems, or computers.

Each of the components of the computer 802 can communicate using a system bus 803. In some implementations, any or all of the components of the computer 802, both hardware or software (or a combination of hardware and software), may interface with each other or the interface 804 (or a combination of both) over the system bus 803 using an application programming interface (API) 812 or a service layer 813 (or a combination of the API 812 and service layer 513. The API 812 may include specifications for routines, data structures, and object classes. The API 812 may be either computer-language independent or dependent and refer to a complete interface, a single function, or even a set of APIs. The service layer 813 provides software services to the computer 802 or other components (whether or not illustrated) that are communicably coupled to the computer 802. The functionality of the computer 802 may be accessible for all service consumers using this service layer. Software services, such as those provided by the service layer 813, provide reusable, defined business functionalities through a defined interface. For example, the interface may be software written in JAVA, C++, or other suitable language providing data in extensible markup language (XML) format or other suitable format. While illustrated as an integrated component of the computer 802, alternative implementations may illustrate the API 812 or the service layer 813 as stand-alone components in relation to other components of the computer 802 or other components (whether or not illustrated) that are communicably coupled to the computer 802. Moreover, any or all parts of the API 812 or the service layer 813 may be implemented as child or sub-modules of another software module, enterprise application, or hardware module without departing from the scope of this disclosure.

The computer 802 includes an interface 804. Although illustrated as a single interface 804 in FIG. 8, two or more interfaces 804 may be used according to particular needs, desires, or particular implementations of the computer 802. The interface 804 is used by the computer 802 for communicating with other systems in a distributed environment that are connected to the network 830. Generally, the interface 804 includes logic encoded in software or hardware (or a combination of software and hardware) and operable to communicate with the network 830. More specifically, the interface 804 may include software supporting one or more communication protocols associated with communications such that the network 830 or interface's hardware is operable to communicate physical signals within and outside of the illustrated computer 802.

The computer 802 includes at least one computer processor 805. Although illustrated as a single computer processor 805 in FIG. 8, two or more processors may be used according to particular needs, desires, or particular implementations of the computer 802. Generally, the computer processor 805 executes instructions and manipulates data to perform the operations of the computer 802 and any algorithms, methods, functions, processes, flows, and procedures as described in the instant disclosure.

The computer 802 also includes a memory 806 that holds data for the computer 802 or other components (or a combination of both) that can be connected to the network 830. For example, memory 806 can be a database storing data consistent with this disclosure. Although illustrated as a single memory 806 in FIG. 8, two or more memories may be used according to particular needs, desires, or particular implementations of the computer 802 and the described functionality. While memory 506 is illustrated as an integral component of the computer 802, in alternative implementations, memory 806 can be external to the computer 802.

The application 807 is an algorithmic software engine providing functionality according to particular needs, desires, or particular implementations of the computer 802, particularly with respect to functionality described in this disclosure. For example, application 807 can serve as one or more components, modules, applications, etc. Further, although illustrated as a single application 807, the application 807 may be implemented as multiple applications 807 on the computer 802. In addition, although illustrated as integral to the computer 802, in alternative implementations, the application 807 can be external to the computer 802.

There may be any number of computers 802 associated with, or external to, a computer system containing computer 802, each computer 802 communicating over network 830. Further, the term "client," "user," and other appropriate terminology may be used interchangeably as appropriate without departing from the scope of this disclosure. Moreover, this disclosure contemplates that many users may use one computer 802, or that one user may use multiple computers 802.

In some embodiments, the computer 802 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. A downhole sub comprising:

a body defined by a wall extending in an axial direction from a first end to a second end, wherein an inner surface of the wall defines a flow path through the downhole sub and an outer surface of the wall defines an outer diameter of the downhole sub;

a compartment extending from the outer surface into the wall to having a depth less than a thickness of the wall;

a housing removably fixed in the compartment;

one or more mobile devices disposed in the housing, wherein each of the one or more mobile devices comprises a sensor encapsulated in a protective material;

a plug blocking an opening of the housing, wherein the plug is made of a dissolvable material configured to dissolve at a predetermined depth in a wellbore and release the one or more mobile devices into the wellbore wherein the housing comprises a storage compartment to store the one or more mobile devices, and wherein the opening extends a length from a top surface of the housing to the storage compartment, and the plug is coupled into the opening, and a back lid removably fixed in a slot of the housing to close a bottom of the storage compartment.

2. The downhole sub of claim 1, wherein the dissolvable material is a metallic material having a magnesium based alloy or an aluminum based alloy.

3. The downhole sub of claim 1, wherein the dissolvable material is a non-metallic material having a polyglycolic acid (PGA), polylactic acid (PLA), or polyurethane (PU).

4. The downhole sub of claim 1, wherein the housing comprises a fluid inlet in fluid communication with the storage compartment.

5. The downhole sub of claim 4, wherein the housing comprises a ledge configured to guide fluids into the fluid inlet.

6. A downhole sub comprising:

a body defined by a wall extending in an axial direction from a first end to a second end, wherein an inner surface of the wall defines a flow path through the downhole sub and an outer surface of the wall defines an outer diameter of the downhole sub;

a compartment extending from the outer surface into the wall to having a depth less than a thickness of the wall;

a housing removably fixed in the compartment;

one or more mobile devices disposed in the housing, wherein each of the one or more mobile devices comprises a sensor encapsulated in a protective material; and a plug blocking an opening of the housing, wherein the plug is made of a dissolvable material configured to dissolve at a predetermined depth in a wellbore and release the one or more mobile devices into the wellbore, wherein the housing comprises a storage compartment to store the one or more mobile devices, wherein the opening extends a length from a top surface of the housing to the storage compartment, and the plug is coupled into the opening, and wherein the housing comprises a fluid inlet in fluid communication with the storage compartment.

7. The downhole sub of claim 6, further comprising a back lid removably fixed in a slot of the housing to close a bottom of the storage compartment.

8. The downhole sub of claim 6, wherein the housing comprises a ledge configured to guide fluids into the fluid inlet.

9. The downhole sub of claim 6, wherein the dissolvable material is a metallic material having a magnesium based alloy or an aluminum based alloy.

10. The downhole sub of claim 6, wherein the dissolvable material is a non-metallic material having a polyglycolic acid (PGA), polylactic acid (PLA), or polyurethane (PU).

11. A downhole sub comprising:

a body defined by a wall extending in an axial direction from a first end to a second end, wherein an inner surface of the wall defines a flow path through the downhole sub and an outer surface of the wall defines an outer diameter of the downhole sub;

a compartment extending from the outer surface into the wall to having a depth less than a thickness of the wall;

a housing removably fixed in the compartment;

one or more mobile devices disposed in the housing, wherein each of the one or more mobile devices comprises a sensor encapsulated in a protective material; and a plug blocking an opening of the housing, wherein the plug is made of a dissolvable material configured to dissolve at a predetermined depth in a wellbore and release the one or more mobile devices into the wellbore, wherein the housing comprises a storage compartment to store the one or more mobile devices, wherein the opening extends a length from a top surface of the housing to the storage compartment, and the plug is coupled into the opening, wherein the housing comprises a fluid inlet in fluid communication with the storage compartment, and wherein the housing comprises a ledge configured to guide fluids into the fluid inlet.

12. The downhole sub of claim 11, further comprising a back lid removably fixed in a slot of the housing to close a bottom of the storage compartment.

13. The downhole sub of claim 11, wherein the dissolvable material is a metallic material having a magnesium based alloy or an aluminum based alloy.

14. The downhole sub of claim 11, wherein the dissolvable material is a non-metallic material having a polyglycolic acid (PGA), polylactic acid (PLA), or polyurethane (PU).

* * * * *